US005419375A

United States Patent [19]

Corain et al.

[11] Patent Number: 5,419,375

[45] Date of Patent: May 30, 1995

[54] INDEPENDENTLY DRIVEN SELVEDGE FORMING LENO WEAVING DEVICE

[75] Inventors: Luciano Corain, Vicenza; Giulio Bortoli, Schio, both of Italy

[73] Assignee: Nuovopignone - Industrie Meccaniche e Fonderia S.p.A., Florence, Italy

[21] Appl. No.: 194,157

[22] Filed: Feb. 9, 1994

[30] Foreign Application Priority Data

Feb. 11, 1993 [IT] Italy ..... MI93A0234

[51] Int. Cl.[6] ..... D03D 47/40; D03D 7/00

[52] U.S. Cl. ..... 139/54; 139/50

[58] Field of Search ..... 139/50, 54

[56] References Cited

U.S. PATENT DOCUMENTS

| | | | |
|---|---|---|---|
| 2,918,945 | 12/1959 | Hall | 139/54 |
| 3,256,913 | 6/1966 | Neumann | 139/54 |
| 3,952,778 | 4/1976 | Volpe | 139/54 |
| 5,353,845 | 10/1994 | Corain et al. | 139/54 |

FOREIGN PATENT DOCUMENTS

| | | |
|---|---|---|
| 0368402 | 5/1990 | European Pat. Off. . |
| 0371257 | 6/1990 | European Pat. Off. . |
| 0393467 | 10/1990 | European Pat. Off. . |
| 0450120 | 10/1991 | European Pat. Off. . |
| 2238553 | 6/1991 | United Kingdom . |

*Primary Examiner*—Andrew M. Falik

*Attorney, Agent, or Firm*—Oblon, Spivak, McClelland, Maier, & Neustadt

[57] ABSTRACT

A loom with a leno-weaving device which can act completely within the loom heddle frames, with the two links of the leno-weaving device slidably supported within a slide guide. The slide guide extends from within the heddle frames, and is located above the reed, with the two links driven by a single cam drive and a pair of spring-loaded pushers. The spring-loaded pushers can extend into the heddle frames, and are connected to one end of the links, with the links thus raised and lowered within the heddle frames while being slidingly supported by the slide guide. An advantageous cam drive can also be provided which allows for switching of the mode of the operation, to switch the type of weaving being performed by axially moving a shaft upon which cams of the cam drive are mounted.

4 Claims, 2 Drawing Sheets

1
2
3
4
5
6
7
8
9
10
11
12
13
14
15
16
17
19
20
21
22
23
24
25
26
27
28
28'
29
30
31
32
33

INDEPENDENTLY DRIVEN SELVEDGE FORMING LENO WEAVING DEVICE

BACKGROUND OF THE INVENTION

1. Field of the Invention

This invention relates to loom improvements which enable the loom heddle frames to be positioned as close as possible to the shed vertex or fabric formation line as is compatible with the size only of the swinging reed while maintaining a minimum thickness of the leno-weaving device, of an independently driven type, within its region of operation, hence resulting in a considerable reduction in mechanical stresses on the heddle frame drive members, the achieving of a cleaner shed and hence a higher loom efficiency, and the possibility of forming fabrics of greater width on the same loom.

2. Discussion of the Background

As is well known, in looms it is always sought to position the heddle frames as close as possible to the shed vertex or fabric formation line, i.e., basically as close as possible to the rear dead center of the swing of the beating reed, such an arrangement resulting in considerable advantages.

In this respect, the shorter travel required of the heddle frames for equal shed opening angles results in evident reduced stresses in the warp yarns and lower mechanical stresses on the drive members of said heddle frames, with obvious economical and operational advantages. Again, the consequent reduction in length of the warp yarn portions extending from the heddles of the heddle frames to said shed vertex or fabric formation line results in reduced elastic yielding of said yarn portions, ensuring a more effective and immediate separation of any adjacent warp yarns stuck together, with the advantage of a cleaner shed and a consequent increase in loom efficiency.

However, to prevent unravelling of the fabric under formation, its edges are generally protected by a leno-weave obtained by a suitable device.

Various types of leno-weaving device are already known in the state of the art.

In one of the known types, the two links of the device are inserted into the first two heddle frames of the loom and are alternately lowered and raised by said two first heddle frames respectively.

Although this arrangement reduces weft wastage to a minimum in that the thickness of the device within the operating region is a minimum and also enables fabrics of greater height to be formed on the same loom, it has the serious drawback, by using the first two heddle frames for its drive, of inevitably moving the position of the operating heddle frames rearward from said shed vertex or fabric formation line, with evident negative consequences in the light of the foregoing. A further drawback is the need to use and keep in movement the said two heddle frames only for operating the leno-weaving device, with a consequent increase in the total number of heddle frames and hence in mechanical stresses.

To obviate this drawback, independently driven leno-weaving devices have been used, namely devices comprising two links which are slidable along a suitable central member and are alternately raised and lowered by separate drive members other than heddle frames or false selvedge forming devices.

Such independently driven leno-weaving devices have however to be interposed between the swinging reed and the first heddle frame, hence introducing the said drawbacks due to the necessary positioning of the operating heddle frames rearwardly from said shed vertex or fabric formation line. Again, the presence in said independently driven leno-weaving devices of self-contained drive members and their specific construction means that some of said known devices have a considerable thickness within the region of operation, with consequent weft wastage.

SUMMARY OF THE INVENTION

The object of the present invention is precisely to obviate the foregoing drawbacks by providing improvements which enable an independently driven leno-weaving device to be used without this prejudicing the close approach of the heddle frames to the shed vertex or more precisely to the rear dead center of the swing of the beating reed, and without weft wastage occurring.

This is substantially attained in that the leno-weaving device is made to act within the heddle frames by a slide guide which emerges from the heddle frames, and by a single cam drive acting from below against the device links by spring-loaded pushers which are inserted into said heddle frames.

Hence, the present invention provides improvements in a loom in which a reed swings between a rear dead center position and the fabric formation line or vertex of the shed formed by the warp yarns passing through the heddle eyes of the heddle frames. The loom includes a and a leno-weaving device consisting of two links slidable along a central member and alternately raised and lowered by drive members. According to the present invention, in that the two links of said leno-weaving device are slidingly supported within the heddle frames by a slide guide which emerges from said heddle frames and above the reed when in its rear dead center position and are driven by a single cam drive cooperating respectively with two spring-loaded pushers which are inserted into said heddle frames to be connected only to one end of said links.

In order to be able to produce the leno-weave not only at each beat of the reed but also at every two beats, as is often required, according to a further characteristic of the present invention the single cam drive includes two cam pairs which are keyed onto the same shaft and can be individually brought into cooperation with said pushers by a simple axial movement of said shaft, one pair of cams being contoured to move said links of the leno-weaving device at each beat of the reed and the other pair at every two beats.

BRIEF DESCRIPTION OF THE DRAWINGS

The invention is further clarified hereinafter with reference to the accompanying drawings which illustrate a preferred embodiment thereof given by way of a non-limiting example, since technical or constructional modifications can be made thereto without departing from the scope of the present invention.

In the drawings.

DESCRIPTION OF THE PREFERRED EMBODIMENT

Figure 1:
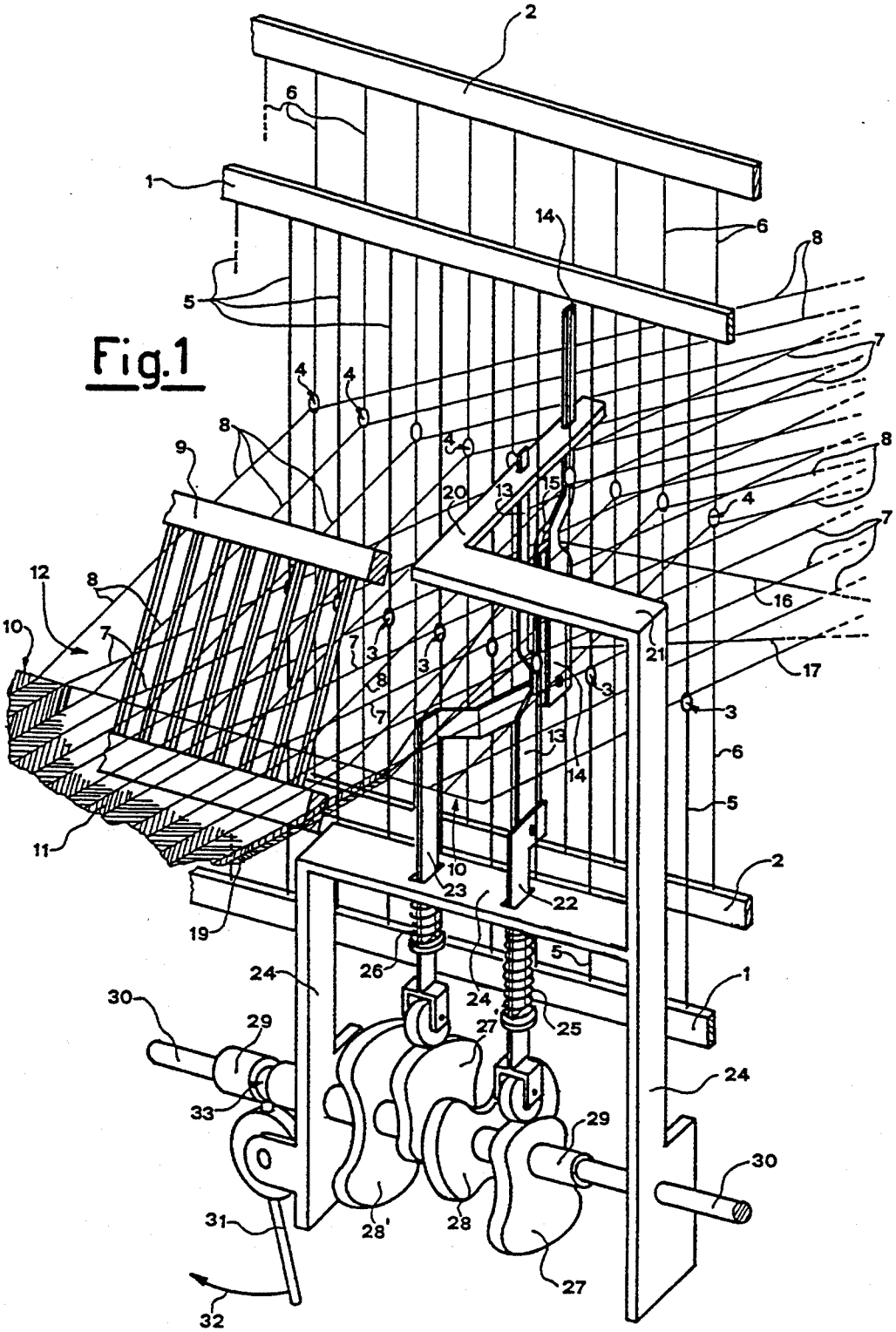
FIG. 1 is a partial perspective view of that part of the loom concerned with the improvements according to the invention.

In the figures the reference numerals 1 and 2 indicate the first two loom heddle frames. The warp yarns 7, 8 pass through the eyes 3 and 4 respectively of the heddles 5 and 6 after originating from the warp beam, not shown, and pass through the teeth of the beating reed 9, to meet the line 10 of formation of the fabric 11 or vertex of the shed 12.

Figure 2:
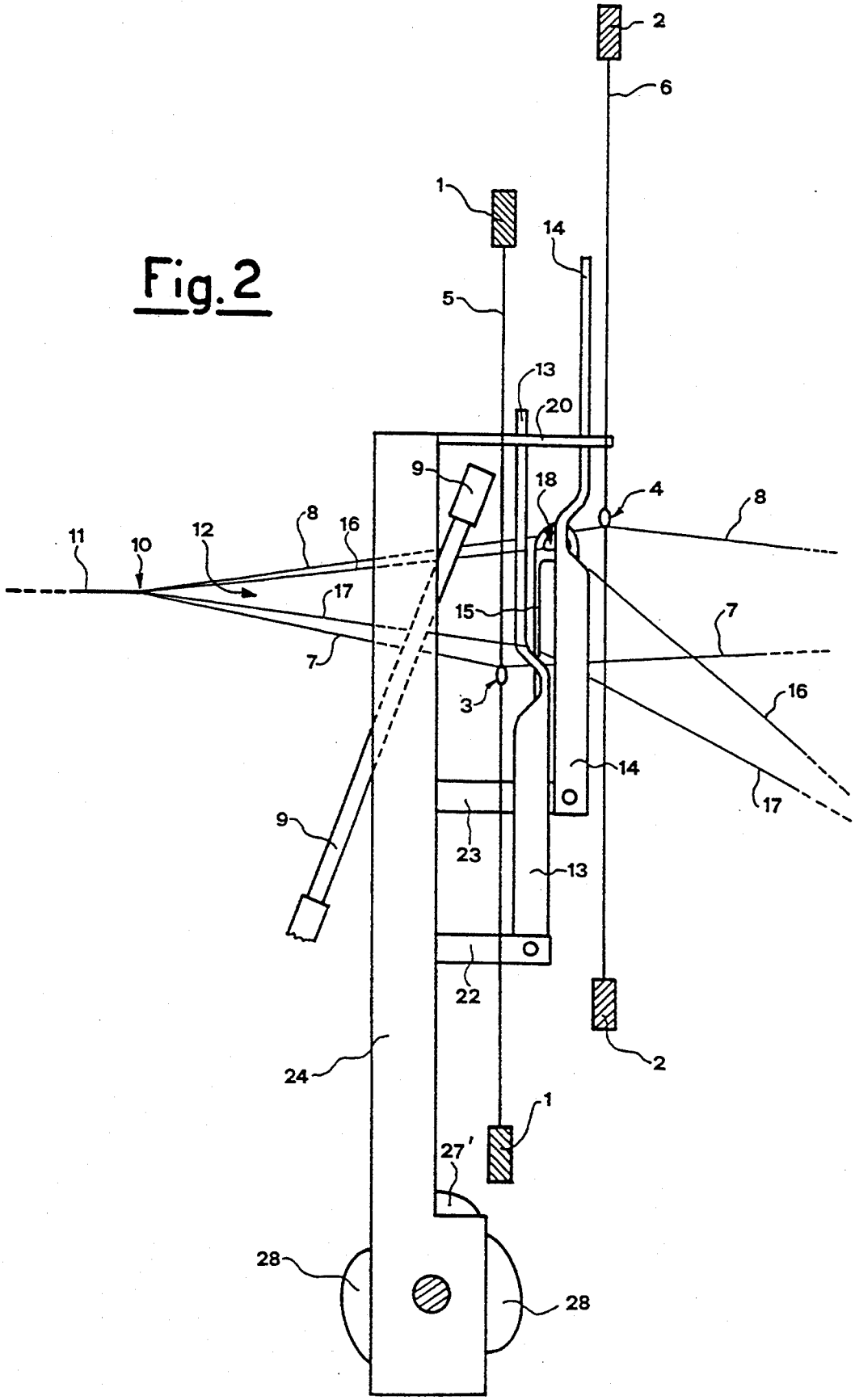
FIG. 2 is a side view of FIG. 1.

The leno-weaving device includes the two links 13 and 14, which slide along the central member 15 and have to be alternately raised and lowered to cross-over the binding yarns 16 and 17. The binding yarns 16, 17 pass through an eyelet 18 in the central member and between the central member and the links to form the leno-weave 19 on the edge of the fabric 11. Thus, the leno-weaving device according to the invention is completely embedded within the two heddle frames 1 and 2 so that the first heddle frame 1 can be brought extremely close to the reed 9 when in that position corresponding to the Fear dead center of its swing, as clearly shown in FIG. 2, and hence as close as possible to the vertex 10 of the shed 12 or fabric formation line.

For this purpose the two links 13 and 14 of the leno-weaving device are slidingly supported by a slide guide 20 which emerges from the heddle frame 1 above the reed 9 when in its rear dead center position (see FIG. 2) and extends via the structure 21 out of the weaving region towards the side of the loom.

The two links 13 and 14 are moved by two pushers 22 and 23 which via their substantially L-shaped appendix are inserted into the first heddle frame 1 to hinge to the lower end of the link 13 and link 14 respectively, with the pushers being slidingly supported by a support 24 and being loaded by a spring, 25 and 26 respectively, against one of two pairs of cams 27–27′ and 28–28′ which are contoured to move the links at every two beats of the reed 9 against the fabric formation line 10 of at each beat respectively. For this purpose the cam pairs 27–27′ and 28–28′ are keyed onto a single shaft 29 which rotates rigidly with a coaxial drive shaft 30 rotating at one quarter of the loom speed, but can slide along the drive shaft 30 by the action of a control lever 31 which is rotatable in the direction of the arrow 32 and engages a circumferential groove 33 in said shaft 29.

In this manner, by simply rotating the lever 31, one or other of said cam pairs can be made to act against said pushers 22 and 23, to hence vary the type of leno-weave.

We claim:

1. A loom comprising:

two heddle frames each including heddle eyes, a reed swinging between a rear dead center position and a fabric formation line or vertex of a shed formed by warp yarns passing through the heddle eyes of the two heddle frames, and a leno-weaving device which includes two links slidable along a central member and alternately raised and lowered by drive members;

wherein the two links of said leno-weaving device are slidingly supported within the heddle frames by a slide guide which extends from within at least one of the two heddle frames, and wherein said slide guide is disposed at a position which is above said reed when said reed is in the rear dead center position, and wherein said drive members which raise and lower said two links include a single cam drive and two spring-loaded pushers which are driven by said single cam drive, and wherein each of said two spring-loaded pushers is connected to a respective one of said two links at one end of each of the respective two links.

2. The loom of claim 1, wherein said single cam drive comprises two cam pairs which are positioned upon a shaft such that each cam pair can be individually brought into cooperation with said pushers by axially moving said shaft, one pair of cams being contoured to move said links of the leno-weaving device at each beat of the reed and the other pair at every two beats.

3. The loom of claim 1, wherein a portion of each of said two spring-loaded pushers extends to a location within at least one of said two heddle frames.

4. The loom of claim 3, wherein said spring-loaded pushers are connected to only one end of said two links.

* * * * *